United States Patent [19]

Kelly

[11] 4,325,498

[45] Apr. 20, 1982

[54] PRESSURIZED PORTABLE ELASTIC MEMBRANE LIQUID CONTAINER

[75] Inventor: Quentin T. Kelly, Hopewell, N.J.

[73] Assignee: Pressurized Products, Inc., Princeton, N.J.

[21] Appl. No.: 95,602

[22] Filed: Nov. 19, 1979

[51] Int. Cl.[3] ..... B65D 37/00

[52] U.S. Cl. ..... 222/210; 222/215

[58] Field of Search ..... 222/105, 210, 212, 206, 222/215, 386.5; 220/85 B

[56] References Cited

U.S. PATENT DOCUMENTS

| | | | |
|---|---|---|---|
| 3,880,323 | 4/1975 | Viehe | 222/210 X |
| 3,929,262 | 12/1975 | Viehe | 222/212 X |
| 3,989,170 | 11/1976 | Viehe | 222/212 |

FOREIGN PATENT DOCUMENTS

| | | | |
|---|---|---|---|
| 1375474 | 9/1964 | France | 222/210 |

OTHER PUBLICATIONS

*Plastics Engineering Handbook,* Frados; Van Nostrand Reinhold Co., N.Y., 1976, pp. 116, 117 and 646–649.

*Plastics Materials,* Brydson; Newnes–Butterworths, London, 1975, pp. 129, 242, 243.

*Primary Examiner*—David A. Scherbel

*Attorney, Agent, or Firm*—Richard C. Woodbridge

[57] ABSTRACT

In a preferred embodiment, a pressurized portable elastic membrane liquid container having an expandable circular elastic membrane of which a central location thereof has an integrally molded handle extending upwardly and a boss of increased thickness of the membrane extending downwardly from a bottom face of the membrane from beneath the handle, with the boss extending radially outwardly from said central location for a distance of about one-half radius of the circular elastic membrane, and with an additional boss in the form of a circular ridge extending upwardly from a top surface of the membrane with the ridge extending above a plurality of mold injection points located in juxtaposition to an outer periphery of said circular elastic membrane, the membrane being of polyisopreme base rubber and including an ozone inhibitor.

3 Claims, 2 Drawing Figures

PRESSURIZED PORTABLE ELASTIC MEMBRANE LIQUID CONTAINER

This invention relates to a novel self pressurized portable container having improved durability against rupture.

BACKGROUND OF THE INVENTION

Prior to the present invention, somewhat analagous self-pressurized portable containers have been the subject matter of the U.S. Pat. No. 3,895,742 to Wulbern, and U.S. Pat. Nos. 3,989,170 and 3,929,262 and 3,880,323 to Viehe. While each of the U.S. Pat. Nos. 3,989,170 and 3,880,323 disclose that a central portion of the circular expandable elastic membrane is thicker than its peripheral portions becoming uniformly thinner radially outwardly from a central location of the membrane, the commercial industry has nevertheless been plagued with continued ruptures of the membrane. There is an obvious limit as to how thick the entire circular elastic membrane may be in order to remain operative in its required sufficient degree of elasticity as to permit it to baloon as a water container as water is under pressure forced into the enclosure beneath the membrane. It is apparent that if the thickness of this membrane is too great, that such excessive thickness will result in and in fact increase the probability of rupture when sufficient liquid pressure forces expansion thereof. Moreover, the portable containers of the above-noted type are high susceptible to rupture when exposed to sunlight over a period of extended usage, as the present Applicant has found to be the result of ozone deteriorating effect on the elastic membrane. Moreover, the present applicant has discovered that many elastic or rubber membranes are highly susceptible to rupture, and Applicant has discovered improved composition for the manufacture of these type of vessels.

SUMMARY OF THE INVENTION

Accordingly, objects of the invention include the overcoming or avoiding of problems and difficulties of the types described above.

In particular, an object of the present invention is to avoid rupture of the circular elastic membrane at points in the vicinity of any one or more points either at or adjacent to a central location of the circular membrane or weak injection points adjacent an outer circumscribing periphery of the circular membrane.

Another object is to obtain an improved vessel of the type described-above, in which rubber injection points characteristically weak and subject to rupture are rendered durable.

Another object is to obtain an improved vessel of the type described-above, having improved durability against rupture when exposed to sunlight.

Other objects become apparent from the preceding and following disclosure.

One or more objects of the invention are obtained by the invention as described hereafter as diagrammatically illustrated in the accompanying drawings intended to merely improve understanding of the invention but not to unduly limit the scope of the invention which extends beyond the illustrative drawings.

Broadly the invention may be described as a self pressurized portable container for liquid such as water, having a bottom sealing ring plate with a passage therethrough, and a pressure plate of about circular shape having a through-passage bore therethrough for passage of liquid from container space to and from exterior space, and a substantially circular elastic membrane having its peripheral edges mounted and anchored in a fluid-seal fashion as grasped between the bottom of the pressure plate and outer peripheral edges of the bottom sealing ring plate that is nested and seated against the lower face of the pressure plate. The bore of the pressure plate is substantially aligned in a conventional manner and state with the passage in the ring plate. The improvement arises from a major increase in thickness in the nature of a boss on a surface of the elastic membrane at a membrane location associated with mold injection. It has been determined by Applicant that at each of these injection points, there normally remains embodied within the completed membrane a small void space or bubble which constitutes a weak point. When the membrane is subjected to expanding stresses, eventually one or more cracks begin at this bubble to spread outwardly radially therefrom toward adjacent areas of the elastic membrane, eventually resulting in a rupture at one of the adjacent areas to which the crack has extended. One such bubble weak points is immediately below the integrally-molded handle. Applicant has found that if a boss is provided extending downwardly from a lower face thereof below the bubble, the tendency for a crack to begin forming is substantially reduced or illinated. It has been further discovered that if the overall diameter of the centrally-located boss is increased such that the peripheral edges of the boss extend up to about one-half of the radius of the circular elastic membrane, the possibility of rupture is apparently totally eliminated, while concurrently the membrane remains sufficiently elastic and expandable as to continue to function in the formation of an expanded container in the conventional manner of above-noted patents; such extended-breadth of the boss represents a preferred embodiment of the invention.

Another preferred embodiment constitutes the use of a boss or plurality of joined bosses located at membrane injection points positioned adjacent a periphery of the circular elastic membrane, with the boss(es) extending upwardly from a top surface of the elastic membrane, and preferably in the form of a continuous ridge as a circular ridge which at all points is equidistant from and circumscribing the central location of the circular elastic membrane. By virtue of the continuous circular ridge, greater durability of the circular elastic membrane against rupture is achieved further because thereby such provides for equal expansion and stress on the circular elastic membrane during expansion thereof.

In a preferred composition found to be most durable against deterioration and rupture, the circular elastic membrane utilized is a polyisopreme base rubber of conventional type; in a more preferred embodiment thereof, there is included an ozone inhibitor of conventional type in a conventional quantity normally used in rubber compositions. It should be noted that such ozone inhibitor is not randomly utilized in all rubber products. In the present invention, a projected and actual use is to incorporate a preferred darkening or blackening agaent to enhance enery absorption from radiant energy, such as when exposed to sunlight, whereby the water contents becomes heated for shower purposes. Accordingly, the ozone inhibitor is incorporated by Applicant to make the improved vessel more durable against sunlight deterioration by ozone. Any conventional blackening or darkening agent may be utilized, in a conventional amount and adjusted to achieve the degree of darkness desired.

Other variations are possible, within the spirit of the invention.

Insofar as the present invention pertains to the prior vessels, particularly of the type of above-noted U.S. Pat. No. 3,989,170, the entire disclosure of the above-noted patents is/are hereby incorporated by reference.

The following drawings are intended to illustrate the above-noted improved features of the invention.

THE FIGURES

DETAILED DESCRIPTION

Figure 1:
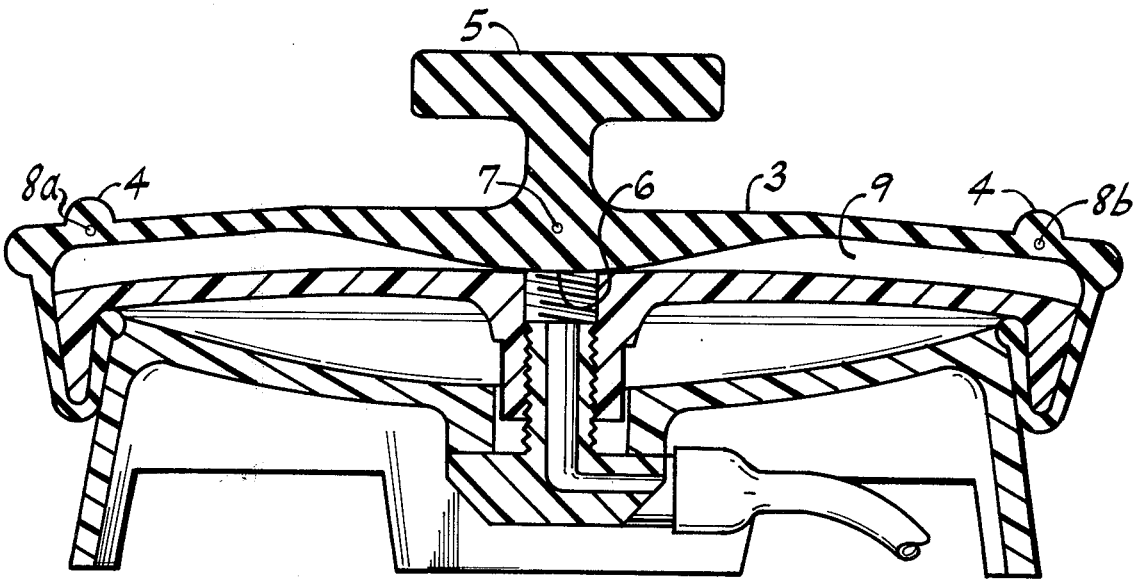
FIG. 1 illustrates diagrammatically a side view cross-section as taken along line 1—1 of FIG. 2.
Figure 2:
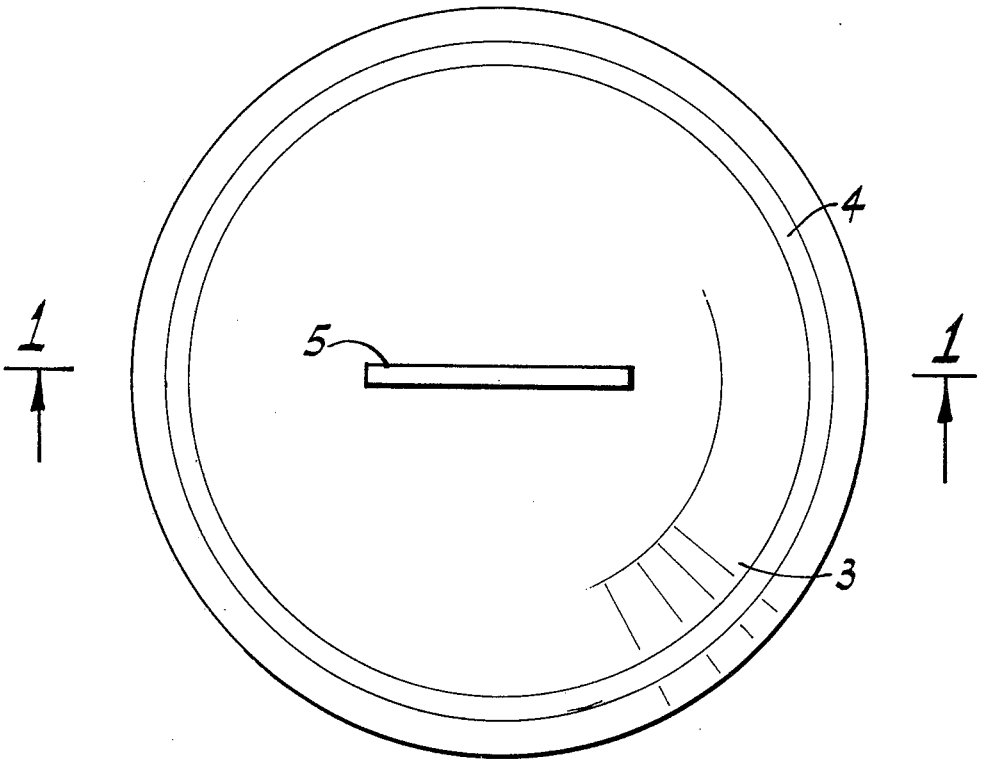
FIG. 2 illustrates a top view of the inventive container of FIG. 1, of this invention.

Making reference to the above-noted FIGS. 1 and 2, the same embodiment is illustrated in both Figures as a self-pressurized portable elastic membrane liquid container typically of conventional structure such as that of U.S. Pat. No. 3,989,170, except for the improvements herein described. The circular elastic membrane 3 has the integrally-molded handle 5 extending from the top face thereof.

Due to the normal molding techniques, after the rubber has been injected into the mold forming the membrane 3, following the hardening of the rubber there is normally left a void space or bubble beneath the surface of the rubber, such as injection location bubbles 7, 8*a*, and 8*b*. By the present invention, boss 6 extending downwardly to a major thickness typically as illustrated, normally a depth ranging from about ¾ inch to about 1½ inches, preferably from about 1 inch to about 1¼ inch, there is prevented a subsequent rupture at radially-outward locations therefrom. Likewise, for the bubbles 8*a* and 8*b* respectively, upwardly extending bosses 4 prevent ruptures from materializing from the adjacent areas affected by the respective weakening bubbles 8*a* and 8*b*. In the more preferred illustrated embodiment as shown in FIG. 2, the outer bosses 4 for the plurality of bubbles 8*a* and 8*b*, are joined in a circular ring circumscribing the central location of the circular elastic sheet 3 circumscing the handle 5 as a ridge, already identified as bosses 4.

As illustrated in FIG. 2, the preferred color or shade of the elastic membrane 3 is black, such that radiant energy may be more readily absorbed to thereby heat water contained in the container space 9, of FIG. 1. The matter of the particular darkening or backening agent is not important, since it is merely the basic physics phenominum that black or dark colors readily absorb heat, that is herein employed for the novel purposes of this invention.

Likewise, the incorporation of ozone inhibitor into rubber is a well known technology, not a part of this invention in so far as the particular type or choice of ozone inhibitor, or as to the desired amount to be employed, such being merely a matter of degree. But for the purposes of utilization of the present invention to heat water by sun radiation, together with the requisite that the elastic membrane be of preferably polyispreme type rubber of conventional components for that type of rubber, it is important for this invention's improved stability against deterioration and consequent rupture, that in a preferred embodiment the ozone inhibitor be utilized as a component of the rubber composition.

It is within the scope of the present invention to make such modifications and variations and substitution of equivalents as would be apparent to a person of ordinary skill in this art.

I claim:

1. A self pressurized portable container for liquid comprising: a bottom sealing ring plate having a passage therethrough; a pressure plate of substantially circular shape having a bore therethrough adapted for the passage of liquid therethrough from above and below upper and lower faces thereof, said bottom sealing ring plate being nested and seated against said lower face with said passage substantially aligned with said bore; and an injection molded substantially circular elastic membrane having a continuous upper wall positioned above said upper face and having circumscribing edges thereof mounted and sealably anchored between said pressure plate and said bottom sealing ring plate at the circumscribing perpheries thereof, said circular elastic membrane having an integrally molded handle extending upwardly from a first central location on a top surface of said circular elastic membrane; the improvement comprising a boss extending downwardly from a second central location on a lower surface of said circular elastic membrane, further comprising a second bose in a form of a circular ridge located at injection points of said circular elastic membrane such that the circular ridge at substantially all points is equidistant from and circumscribes said second central location thereby providing for equal expansion and stress on the circular elastic membrane during expansion thereof; whereby rupture cracks are avoided.

2. A self pressurized portable container of liquid of claim 1, in which said boss extends radially outwardly as a disc shape of decreasing thickness at its edges and extends radially outwardly a distance of about one-half radius of said circular elastic membrane.

3. A self pressurized container comprising: a pressure plate of substantially circular shape having a bore therethrough adapted for passage of liquid therethrough from above and below upper and lower faces thereof; and an injection molded substantially circular elastic membrane having a continuous upper wall positioned above said upper face and having circumscribing edges thereof mounted and sealably anchored to said pressure plate; the improvement comprising a boss on a surface face of said circular elastic membrane, the boss being in a form of a circular ridge located at injection points of said circular elastic membrane such that the circular ridge at substantially all points is equidistant from and circumscribes a central location of the circular elastic membrane whereby rupture cracks are avoided.

* * * * *